United States Patent [19]

Staugaard

[11] 4,235,167

[45] Nov. 25, 1980

[54] HIGH SPEED DUAL PITCH IMPACT PRINTER

[75] Inventor: Kenneth Staugaard, Rochester, Mich.

[73] Assignee: Computer Peripherals, Inc., Minneapolis, Minn.

[21] Appl. No.: 19,393

[22] Filed: Mar. 12, 1979

[51] Int. Cl.[3] ..... B41J 9/12; B41J 1/20

[52] U.S. Cl. ..... 101/93.09; 101/93.14

[58] Field of Search ..... 101/93.09, 93.14, 93.32, 101/111; 400/303, 305, 306

[56] References Cited

U.S. PATENT DOCUMENTS

| | | | |
|---|---|---|---|
| 3,899,968 | 8/1975 | McDevitt | 101/111 |
| 3,952,648 | 4/1976 | Sory et al. | 101/93.14 |
| 4,009,654 | 3/1977 | Harris et al. | 101/93.14 X |
| 4,055,117 | 10/1977 | Munday | 101/93.09 X |
| 4,074,068 | 2/1978 | Wada et al. | 101/93.14 X |
| 4,152,987 | 5/1979 | Sapino | 101/93.09 X |

*Primary Examiner*—Edward M. Coven
*Attorney, Agent, or Firm*—Frederick W. Niebuhr; George J. Muckenthaler; Wilbur Hawk, Jr.

[57] ABSTRACT

An impact printer is capable of printing at either ten characters per inch or fifteen characters per inch by changing the type character carrying member. The print hammers are spaced at the same distance apart as are the type characters on the carrying member or band and the hammers are displaced from a home position by one space for printing the fifteen characters per inch at a higher speed than when printing at ten characters per inch. The hammers are time shared and are caused to be moved or shifted a precise distance of 4 increments of 1/30 inch each for a standard pitch band at ten characters per inch or a precise distance of 2 increments of 1/30 inch each for a compressed pitch band at fifteen characters per inch.

20 Claims, 20 Drawing Figures

HIGH SPEED DUAL PITCH IMPACT PRINTER

BACKGROUND OF THE INVENTION

In higher speed line printing, it has been found that the band or belt type printer has certain advantages over the drum type printer. The band is caused to be driven in continuous manner along a line of printing wherein a plurality of hammers are aligned to be selectively driven into impact with paper or like record media and an associated ribbon and against type characters on the print band. Since it is desired to control the speed of the print band within close tolerances so as to permit driving of the hammers into proper registration with the characters on the print band, the band speed is an important aspect of the printer. The prior art has utilized timing marks on the band, and timing pulses derived from such marks on the print band have served to control the speed of the band by means of servo motor control.

Additionally, it is well known that a type character band includes a plurality of font sets wherein each character of every font set is continuously scanned by the control apparatus so as to fire the selected hammers at the precise time that the characters pass the various print positions. The band may include marks thereon which correspond to the characters and may also include marks to indicate the various font sets with sensing or detecting means being provided to send pulses to the control mechanism at precise times for firing the hammers.

Another feature of the band printer includes the providing of hammers wherein a separate hammer is provided for each print position with a hammer driver for each hammer. Other band printers have utilized time shared hammer techniques wherein the hammers are of multiwidth and span more than one print column position or single width hammers which are movable to more than one print position and are arranged in a bank of hammers with such bank being movable or displaced along a line of printing.

Representative prior art in the area of band printers include U.S. Pat. No. 3,919,933, issued Nov. 18, 1975, to J. T. Potter, which discloses a high speed printer incorporating a type font having an increased number of character spaces for unit length of print line to increase the printing speed. The printing speed is increased by reducing the dimension of character spaces to the size of textbook print with an individual hammer corresponding to each printing character space.

U.S. Pat. No. 4,064,800, issued Dec. 27, 1977 to S. W. Paccione et al, discloses a printer which prints in either direction and which utilizes a barrel cam to shuttle print hammers back and forth across the paper, and several actuators are time-shared among the various print columns of the paper so that there is time sharing of the hammers.

SUMMARY OF THE INVENTION

The present invention relates to impact printers and more particularly, to an impact printer which is capable of printing at ten characters per inch, or fifteen characters per inch by merely changing the type character carrying member. The printer includes an endless band which is carried on a pair of pulleys and is caused to be driven in continuous manner along a line of printing and adjacent a plurality of time-shared hammers of the impact type which hammers impact with paper or like record media and with an ink ribbon traveling in a path between the face of the hammers and the type characters on the band. One band which is utilized on the printer is referred to as a standard pitch band and a second band is referred to as a compressed pitch band for purposes of dual pitch character printing at 1/10 inch character spacing or at 1/15 inch character spacing. Each type band may be utilized for printing on the same machine with all of the bands being of the same length and having 384 characters on the periphery thereof with different character formats or font sets making up the total number of characters. For example, the band may carry either eight sets of 48 characters, six sets of 64 characters, four sets of 96 characters or three sets of 128 characters. The characters are etched or embossed on the band so as to present a raised type surface and are spaced on center lines of 4/30 inch.

The print hammers and the drivers for the hammers are time-shared wherein each hammer is displaced or moved a precise distance to cover at least two printable locations or positions on the record media for compressed pitch printing and at least four printable positions for standard pitch printing. Another way of stating the time-sharing principle is that a one-to-one relationship between the number of imprinted columns on the paper and the hammers does not exist. The faces of the hammers are carried by a hammer bar assembly which is moved in precise increments of 1/30 inch in relation to the paper by horizontal advancement means.

Independent of which type of character band, whether standard or compressed pitch, is installed on the printer, the hammer bank is displaced in 1/30 inch increments. The amount of displacement for a standard pitch band requires three increments of 1/30 inch to complete a print cycle wherein printing is spaced on 1/10 inch centers. The amount of displacement for a compressed pitch band requires two increments of 1/30 inch to complete a print cycle wherein printing is spaced on 1/15 inch centers. Movement or displacement of the hammer bar assembly is sensed by means of a light source, a sensor and a grid arrangement wherein a sine wave or a flat topped sine wave signal, hereafter referred to as sine wave, is generated at precise intervals of 1/30 inch. During standard pitch operation, every third pulse signifies one complete horizontal shift of the hammer bar assembly, while every second pulse signifies a complete shift of the hammer bar assembly during compressed pitch operation.

In accordance with the above discussion, the principal object of the present invention is to provide a printer capable of printing at either ten characters per inch or fifteen characters per inch, as determined by the type character carrying member placed on the printer.

An additional object of the present invention is to provide a printer capable of dual-pitch printing and which includes controls responsive to the format of the type character carrier on the printer.

Another object of the present invention is to provide a printer having time-sharing print hammers operable with associated controls and responsive to the type character carrying member on the printer.

A further object of the present invention is to provide a printer capable of dual-pitch printing and includes controls for operating the hammers in time-shared manner at a higher speed for compressed pitch.

Another object of the present invention is to provide a printer capable of printing at a higher printing speed when operating in the compressed pitch mode of fifteen characters per inch, and capable of printing at a lower printing speed when operating in the standard pitch mode of ten characters per inch.

Additional advantages and features of the present invention will become apparent and fully understood from a reading of the following description, taken with the annexed drawing.

DESCRIPTION OF THE PREFERRED EMBODIMENT

Figure 1:
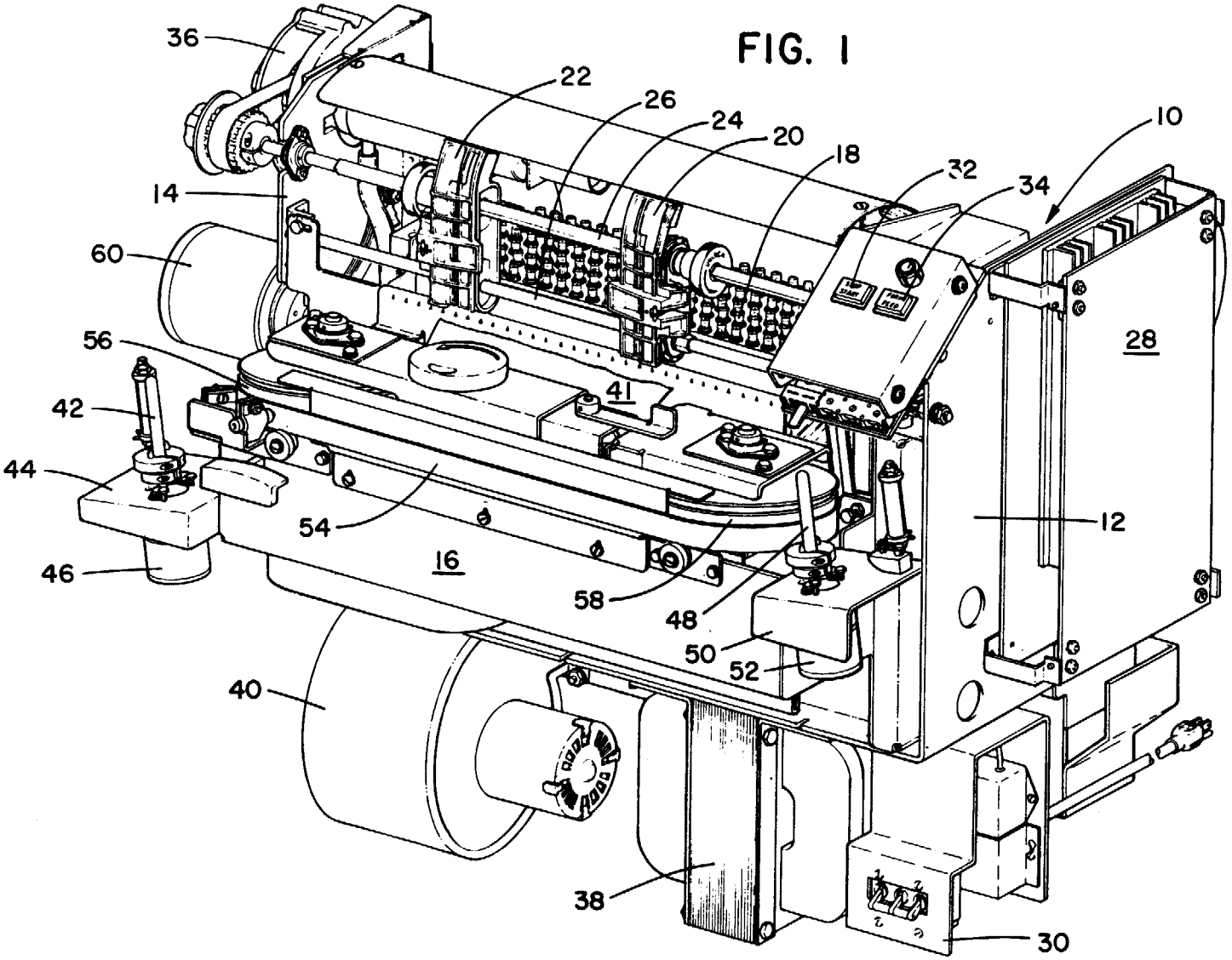
FIG. 1 is a perspective view of a portion of a printer incorporating the subject matter of the present invention.

As seen in FIG. 1, a printer 10 incorporating the subject matter of the present invention utilizes a band for carrying the type characters thereon, such band printer distinguishing from a drum printer in a number of areas and features with the most significant area being the type carrying structure. The printer 10 of course includes the framework of vertical side plates 12 and 14 which support the print band gate structure 16, the hammer bank 18, the paper forms tractors 20 and 22 carried on shafts 24 and 26, the power supply and servo drive 28 and other major parts which will be explained in further detail. An on/off switch 30 is located at the lower right front of the printer, a start/stop switch 32 and a forms feed switch 34 are positioned on the top right front of the printer, and forms handling mechanism 36 is located on the left side of the printer. A transformer 38 and a blower unit 40 are disposed under the gate structure 16 with the blower unit providing cooling to the various areas and parts of the printer.

Form paper or like record media 41 is caused to be driven or pulled by the tractors 20 and 22 from a forms stack below the gate structure 16, upwardly past the printing station between a type character band 54 and the hammer bank 18, and out an exit slot at the rear of the printer. A ribbon, although not shown in FIG. 1, is caused to be driven from a ribbon spool rotatable on a spindle 42 which is supported on a frame member 44 and driven by a motor 46 located at the left side of the gate structure 16, the ribbon being guided in a path rearward of the gate structure and onto a ribbon spool which is rotatable on a further spindle 48 which is supported on a frame member 50 and driven by a motor 52 at the right side of the gate structure 16.

The print or type band 54 is caused to be driven in a counterclockwise direction by the drive pulley 56, at the left side of the gate structure 16, and around a driven or idler pulley 58 located at the right side of the structure 16, the band 54 being directed in a path adjacent a platen (not shown in FIG. 1) and past a print station and positioned to be impacted by print hammers aligned in a horizontal manner forward of the hammer bank 18. A hammer bank drive motor 60 is provided for driving or moving the hammer bank or hammer bar in a horizontal direction for purposes which will be later described.

For purposes of information, the print band support mechanism, the forms handling control mechanism, the tracking mechanism for the inking ribbon, the paper forms clamping mechanism, the print band edge guide and the dual pitch impact printing mechanism include structures which are the subject matter of co-pending applications, Ser. No. 886,328 filed Mar. 13, 1978 of J. R. Moss, now abandoned, continuation of Ser. No. 762,227 filed Jan. 24, 1977, abandoned; Ser. No. 771,582 filed Feb. 24, 1977 of J. L. Mishark et al; Ser. No. 778,767 filed Mar. 17, 1977 of J. R. Moss, now U.S. Pat. No. 4,084,683; Ser. No. 778,766 filed Mar. 17, 1977 of J. R. Moss, now U.S. Pat. No. 4,091,912; Ser. No. 939,154 filed Sept. 1, 1978 of T. T. Hardt, continuation of Ser. No. 799,843 filed May 23, 1977, abandoned; Ser. No. 803,322 filed June 3, 1977 of A. P. Sapino et al, now U.S. Pat. No. 4,152,981 respectively, and assigned to the same assignee as the present application.

Figure 2:
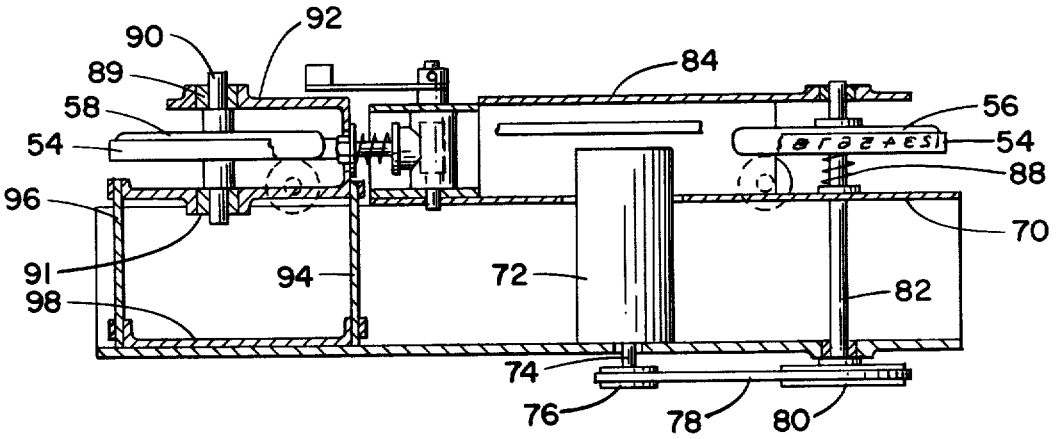
FIG. 2 is an elevational view of the print band gate structure with portions removed therefrom and showing the print band drive mechanism.

In FIG. 2 is shown an elevational view of the gate structure 16, partly in cross-section to better show the various parts, such structure including an enclosed framework 70 supporting a motor 72 having a drive shaft 74 for rotating a pulley 76 about which a belt 78 is trained for driving a pulley 80 on a shaft 82 supported from and journaled in suitable bearings in the framework 70 and in an upper frame member 84 and causing rotation of the drive pulley 56 about which the print band 54 is trained. Such print band 54 is of the endless belt type and, as mentioned above, follows a path adjacent the platen and past the print station where the print hammers impact against type characters on the band. The drive pulley 56 is fixed in location, but the driven or idler pulley 58 is supported in a manner to be movable in a direction toward and away from the drive pulley 56, as will be more fully explained. As illustrated in FIG. 2, pulley 56 is supported on a light spring 88 so as to assume a floating position axially with respect to the shaft 82, such pulley being also crowned to provide proper tracking of the band in relation to the supports and guiding devices therefor.

The idler pulley 58 is carried on a shaft 90 which is journalled in suitable bearings 89 and 91 in a U-shaped frame member or cradle 92 which is secured to a pair of spring-like or flexible leaf spring supporting members 94 and 96 which extend upwardly from a lower portion of the gate structure framework 70, such upwardly extending supporting members 94 and 96 being joined by suitable means to a base member 98 secured to such lower portion of the structure 70 and the upper ends of the members 94 and 96 being secured to opposite ends of the cradle 92. Such spring-like members 94 and 96 are spaced from each other and provide the sole support for the cradle 92, and hence the idler pulley 58, and allow the cradle 92 to move in a direction toward and away from the drive pulley 56. The U-shaped member or cradle 92 is open at one side thereof to permit loading and unloading of the print band 54. The leaf springs 94 and 96 provide the first portion of structure which permits or enables the idler pulley 58 to move toward and away from the drive pulley 56. The axis of the idler pulley shaft 90 remains parallel to its original position while being subjected to horizontal motion or displaced from such original position. The small vertical displacement of the cradle 92 resulting from the horizontal motion has no vertical effect on the pulley system since the pulley 56 is, in effect, floating and is dependent on certain guide means for retaining the band 54 in a vertical position during its travel past the print hammers. In this manner, the idler pulley 58 remains aligned with the drive pulley 56.

Figure 3:
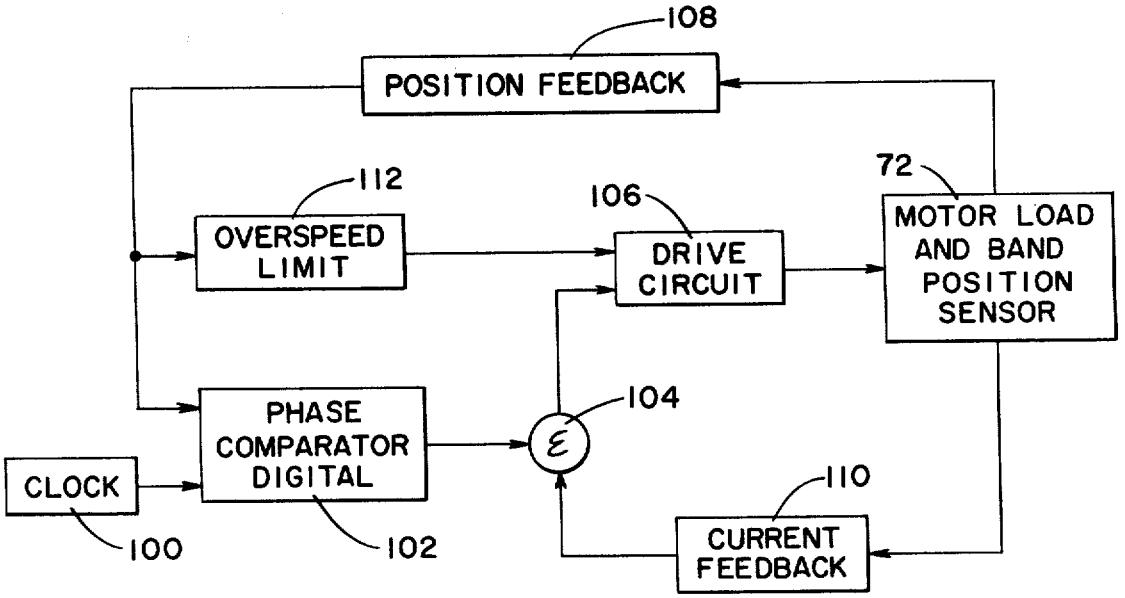
FIG. 3 is a block diagram of essential components of the print band driver control system.

FIG. 3 shows a simplified block diagram of the major components of the band speed control system wherein a clock 100 provides pulses to a phase comparator 102, the output of which is connected to a summation device 104. The output of device 104 is connected to a drive circuit 106, in turn connected to the motor 72 and its associated apparatus. Outputs from the motor 72 and associated apparatus include position feedback circuitry 108 and current feedback circuitry 110, the latter being input to the summation device 104. The position feedback circuitry provides an input to an overspeed limiting device 112 and an input to the phase comparator 102.

In general and broad terms, the clock 100 produces a square wave signal with a fixed frequency which is compared with the position feedback signal at the phase comparator 102, the phase difference between the two signals being a determination of the conduction time which is the time that current flows through the motor 72. Consequently, when the motor 72 starts from the rest position, the frequencies of the clock signal or pulse and of the position feedback signals are different and the conduction time varies with such time having an average of a half period. The conduction time provides for sufficient current to flow to the motor 72 for acceleration thereof to a desired speed or to a speed above the desired speed.

The overspeed limiting device 112 is designed to protect against overspeeding, such device comparing the period of the position feedback signal to a signal of predetermined fixed duration which corresponds to the speed limiting frequency with such limiting frequency being slightly above the frequency of clock 100. As long as the speed of the motor 72 is below the limit or the desired speed, the overspeed limiting circuit is not effective, however, if the speed of the motor is above the permitted limit, the current to the motor is turned off for one time period of position feedback to allow the motor to decelerate to a speed below the desired limit. It is seen that by limiting the motor speed from above a certain speed and by providing acceleration when the speed is too low, it is possible to maintain the band 54 in continuous rotation at a velocity within a desired range.

The development of the standard and compressed pitch system is fully shown and described in the above-identified copending application, Ser. No. 803,322 filed June 3, 1977. The copending application recites and describes various equations starting with the center line distances of the type characters on the band and the center line distances of the imprinted characters on the paper or record media and where it is seen that every fourth print position is aligned with every third character on the print band for a standard pitch band and every second print position is aligned with every character on the band for the compressed pitch band. The several tables in the above application distinguish the developments for the standard pitch and for the compressed pitch along with showing the scan and subscan schemes for the different character pitches.

As mentioned above, the present invention requires that the print hammers be time-shared for the printed to be able to print in standard pitch and also in compressed pitch by only changing the type character band. The faces of the hammers are caused to be displaced or moved in increments of 1/30 inch and a shifting mechanism is developed which is controlled in increments of 1/30 inch so that in the standard pitch machine the hammer faces are shifted at 1/30 inch increments, whereas in the compressed pitch machine, the hammers are shifted at 2/30 inch increments.

In a standard pitch machine, the characters are printed at 1/10 inch (10 characters per inch) and the compressed pitch characters are printed at 1/15 inch (15 characters per inch).

As seen in Table A, the hammers are on 4/30 inch spacings for both standard and compressed pitch. In the standard pitch mode, the hammers must be moved 1/30 inch three times in order to cover all print column locations, whereas in the compressed pitch mode, the hammers must be moved 2/30 inch one time in order to cover all print column locations.

TABLE A

FOUR POSITION - STANDARD PITCH

HMR. 1 2 3 4 5 6

PRT. COL. 1 2 3 4 5 6 7 8

HMR. POS. 0 1 2 3 0 1 2 3 0 1 2 3 0 1 2 3 0 1 2 3 0 1 2

$\frac{1}{30}$"

TWO POSITION - COMPRESSED PITCH

HMR. 1 2 3 4 5 6

PRT. COL. 1 2 3 4 5 6 7 8 9 10 11 12

HMR. POS. 0 1 2 3 0 1 2 3 0 1 2 3 0 1 2 3 0 1 2 3 0 1 2

$\frac{1}{30}$"

It is noted from Table A that the increments of displacement are 1/30 inch for both the standard and the compressed pitch machines, the standard pitch machine being required to be displaced a total of 1/10 inch of the hammer bar to complete a print line and the compressed pitch machine being required to be displaced a total of 1/15 inch to complete a print line. The horizontal motion system has been designed with strobe marks at 1/30 inch intervals and it is only a matter of incrementally moving the horizontal system the required number of marks to present a hammer to each print column—three marks (1/10 inch) for a standard pitch machine, or two marks to achieve 1/15 inch displacement of the hammer bar for a compressed pitch machine. It can be seen from Table A that by time-sharing the hammers for a standard pitch machine having three hammers for every four print columns, that two print columns can be shared with one hammer for a compressed pitch machine.

TABLE B

FOUR POSITION - STANDARD PITCH

| PRT. COL. | 1 | 2 | 3 | 4 | 5 | 6 | 7 | 8 | 9 | 10 | 11 | 12--136 |
|---|---|---|---|---|---|---|---|---|---|---|---|---|
| HMR@ HPC=0 | 1 | | | | 4 | | | | 7 | | | |
| HMR@ HPC=1 | | | | 3 | | | | 6 | | | 9 | |
| HMR@ HPC=2 | | | 2 | | | | 5 | | | | 8 | |
| HMR@ HPC=3 | | 1 | | | | 4 | | | | 7 | | |
| SUBSCAN | | | | | | | | | | | | |
| 1 | Z+0 | | | | Z+3 | | | | Z+6 | | | |
| 2 | | Z+1 | | | | Z+4 | | | | Z+7 | | |
| 3 | | | Z+2 | | | | Z+5 | | | | Z+8 | |
| 4 | | | | Z+3 | | | | Z+6 | | | | Z+9 |
| SR STEP COUNTER | 0 | 1 | 2 | 3 | 0 | 1 | 2 | 3 | 0 | 1 | 2 | 3 |

X=4

Y=3

Band Code Generator

Table B applies to a four position standard pitch machine wherein the horizontal position counter (HPC), the shift register step counter (SR STEP CNTR), Subscan and Band Tracking are introduced. The HPC is utilized to track the position of the hammers (0, 1, 2 or 3). When the hammer bar is in the home position, (HPC=0), hammer 1 is aligned with print column 1 and all hammer faces are aligned with the first, fifth, ninth, etc. print columns. When the horizontal position counter equals 1, (HPC=1), the hammer faces are aligned with the fourth, eighth, twelfth, etc. print columns. When the horizontal position counter equals 2, (HPC=2), the hammer faces are aligned with the third, seventh, eleventh, etc. print columns and when the horizontal position counter equals 3, (HPC=3) the hammer faces are aligned with the second, sixth, tenth, etc. print columns, thus completing the print cycle. The hammer to print column relationship for each HPC is as follows:

| HPC | | | | |
|---|---|---|---|---|
| | HMR | 1 | 4 | 7 |
| 0 | PRT COL | 1 | 5 | 9 |
| | HMR | 3 | 6 | 9 |
| 1 | PRT COL | 4 | 8 | 12 |
| | HMR | 2 | 5 | 8 |

-continued

| HPC | | | | |
|---|---|---|---|---|
| 2 | PRT COL | 3 | 7 | 11 |
| | HMR | 1 | 4 | 7 |
| 3 | PRT COL | 2 | 6 | 10 |

Hammers 1, 4 and 7 cover two print columns each while the interceding hammers cover one print column each, hence three adjacent hammers can cover four print columns. In three 1/30 inch shifts of the hammer bar, all print hammers can cover all print column positions.

As fully described in above-mentioned copending application, Ser. No. 803,322, there are four subscans in the control system which print characters on 1/10 inch centers with characters spaced on the print band at 4/30 inch. The terms Z+0, Z+1, etc. depict which characters are in front of each print column during a given scan, and wherein each scan successively brings a new character in front of print column number one. Subscans 1, 2, 3 and 4 state the times in each scan at which the characters will be aligned with a given group of print columns. For example, at subscan 1, print columns 1, 5, and 9 will have character alignment, and at subscan 2, print columns 2, 6 and 10 will have character alignment.

In order to determine if a hammer is over a given print column position when a comparison with external data is made, a match between the HPC and the SR STEP CNTR is also required. It should be noted that the SR STEP CNTR equals the HPC only when a hammer is aligned with a print column. As should be seen from Table B, four distinct positions (three shifts) are required to option all characters to each print column.

In the case of a 64 character band, 64 scans are required when the hammers are at HPC=0, a shift occurs to HPC=1 and an additional 64 scans are again required, with the process being repeated two more times at HPC=2 and HPC=3. The paper is moved for the next line of printing and data is loaded into the printer and the scanning process is repeated, the exception being that the hammers are moved from position 3 to position 2 to position 1 to position 0.

Table C is similar to Table B except for being applicable to a two position compressed pitch machine. As can be readily seen, Table C is basically a two subscan scheme and each hammer is time shared between only two print columns. In essence, only two horizontal positions are required as compared with four positions for the standard pitch printing. Therefore, it should be obvious from the above that the compressed pitch mode of the printer is approximately two times the speed of the standard pitch machine.

Table B denotes the conditions or bookkeeping required by the control electronics for a four position standard pitch machine whereas Table C denotes the conditions or bookkeeping for a two position compressed pitch machine. The printer control selects either the conditions or bookkeeping in Table B or in Table C by detecting the type band installed on the printer as being standard or compressed pitch, respectively.

TABLE C

TWO POSITION - COMPRESSED PITCH

| | | | | | | | | | | | | |
|---|---|---|---|---|---|---|---|---|---|---|---|---|
| PRT COL | 1 | 2 | 3 | 4 | 5 | 6 | 7 | 8 | 9 | 10 | 11 | 12-- 204 |
| HMRS@ HPC=0 | 1 | | 2 | | 3 | | 4 | | 5 | | 6 | |
| HMR@ HPC=2 | | 1 | | 2 | | 3 | | 4 | | 5 | | 6 |
| SUBSCAN | | | | X=2 | | | | | | | | |
| 1 | Z+0 | | Z+1 | | Z+2 | | Z+3 | | Z+4 | | Z+5 | |
| 2 | | Y=1 | | | | | | | | | | |
| 3 | | Z+1 | | Z+2 | | Z+3 | | Z+4 | | Z+5 | | Z+6 |
| 4 | Band Code Generator | | | | | | | | | | | |
| SR STEP COUNTER | 0 | 2 | 0 | 2 | 0 | 2 | 0 | 2 | 0 | 2 | 0 | 2 |

Referring now to Table D, the relative positions of the hammers to the print columns are shown for the conditions when the hammers are in position 0 (HPC=0) for both the standard and compressed pitch. It should be noted that if memory which contained the data to be printed were addressed or sequenced in the same manner as the print columns, the character band could be tracked by advancing it three times for every four counts of the print counter (3 out of 4). In similar manner, the arrangement would be 1 out of 2 for the compressed pitch mode.

TABLE D

FOUR POSITION - STANDARD PITCH

| | | | | | | | | | | | | |
|---|---|---|---|---|---|---|---|---|---|---|---|---|
| PRT. COL. | 1 | 2 | 3 | 4 | 5 | 6 | 7 | 8 | 9 | 10 | 11 | 12--136 |
| SUBSCAN | | | | X=4 | | | | | | | | |
| 1 | Z+0 | | | | Z+3 | | | | Z+6 | | | |
| 2 | | Z+1 | | Y=3 | | Z+4 | | | | Z+7 | | |
| 3 | | | Z+2 | | | | Z+5 | | | | Z+8 | |
| 4 | | | | Z+3 | | | | Z+6 | | | | Z+9 |
| HMRS. | [1] | X | X | X | [4] | X | X | X | [7] | X | X | X |
| HPC | 0 | 3 | 2 | 1 | 0 | 3 | 2 | 1 | 0 | 3 | 2 | 1 |

TWO POSITION - COMPRESSED PITCH

| | | | | | | | | | | | | |
|---|---|---|---|---|---|---|---|---|---|---|---|---|
| PRT. COL. | 1 | 2 | 3 | 4 | 5 | 6 | 7 | 8 | 9 | 10 | 11 | 12--204 |
| SUBSCAN | | | | X=2 | | | | | | | | |
| 1 | Z+0 | | Z+1 | | Z+2 | | Z+3 | | Z+4 | | Z+5 | |
| 2 | | Y=1 | | | | | | | | | | |
| 3 | | Z+1 | | Z+2 | | Z+3 | | Z+4 | | Z+5 | | Z+6 |
| 4 | | | | | | | | | | | | |
| HMRS. | [1] | X | [2] | X | [3] | X | [4] | X | [5] | X | [6] | X |
| HPC | 0 | 2 | 0 | 2 | 0 | 2 | 0 | 2 | 0 | 2 | 0 | 2 |

NOTE: The above table depicts the hammers at HPC=0.

TABLE E

STANDARD PITCH

| | | | | | | | | | | | | |
|---|---|---|---|---|---|---|---|---|---|---|---|---|
| PLB/PRT COL | 1 | 2 | 3 | 4 | 5 | 6 | 7 | 8 | 9 | 10 | 11 | 12 |
| HMR CNTR | 1 | 1 | 2 | 3 | 4 | 4 | 5 | 6 | 7 | 7 | 8 | 9 |

TABLE E-continued

| | | | | | | | | | | | | |
|---|---|---|---|---|---|---|---|---|---|---|---|---|
| HPC | 0 | 3 | 2 | 1 | 0 | 3 | 2 | 1 | 0 | 3 | 2 | 1 |
| SUBSCAN | 1 | 2 | 3 | 4 | 1 | 2 | 3 | 4 | 1 | 2 | 3 | 4 |

COMPRESSED PITCH

| | | | | | | | | | | | | | | | | | | |
|---|---|---|---|---|---|---|---|---|---|---|---|---|---|---|---|---|---|---|
| PLB/PRT COL | 1 | 2 | 3 | 4 | 5 | 6 | 7 | 8 | 9 | 10 | 11 | 12 | 13 | 14 | 15 | 16 | 17 | 18 |
| HMR CNTR | 1 | 1 | 2 | 2 | 3 | 3 | 4 | 4 | 5 | 5 | 6 | 6 | 7 | 7 | 8 | 8 | 9 | 9 |
| HPC | 0 | 2 | 0 | 2 | 0 | 2 | 0 | 2 | 0 | 2 | 0 | 2 | 0 | 2 | 0 | 2 | 0 | 2 |
| SUBSCAN | 1 | 3 | 1 | 3 | 1 | 3 | 1 | 3 | 1 | 3 | 1 | 3 | 1 | 3 | 1 | 3 | 1 | 3 |

TABLE F

| STANDARD | | | COMPRESSED | | | | HMR |
|---|---|---|---|---|---|---|---|
| SUBSCAN | | HPC | SUBSCAN | | HPC | HMRS | GROUP |
| 1 | & | 0 | 1 | & | 0 | 1,4,7 | 1 |
| OR 2 | & | 3 | OR 3 | & | 2 | | |
| 3 | & | 2 | 1 | & | 0 | 2,5,8 | 2 |
| | | | OR 3 | & | 2 | | |
| 4 | & | 1 | 1 | & | 0 | 3,6,9 | 3 |
| | | | OR 3 | & | 2 | | |

Table E shows the relationship between the PLB/PRT. COL., HMR. CNTR., HPC and Subscan for both the standard and the compressed pitch machines, with the application being for a nine hammer printer. The PLB/PRT COL may be a counter which addresses the memory in which data is to be stored. It is remembered that Tables B and C showed the relationship between the band characters, subscans, and print columns for the standard and compressed pitch, whereas Table E shows the required relationship between the PLB/PRT COL and the HMR CNTR. It is noted that this relationship is similar to that between the PRT COL and the band characters during a scan, in that for every 4 increments of the PLB/PRT COL, only 3 are required for the HMR CNTR (3 out of 4) for the standard pitch machine and 1 out of 2 for the compressed pitch machine.

The HPC may be a counter which records or tracks the position of the hammers. For example, when HPC=0, hammer 1 covers print column 1, hammer 4 covers print column 5 and hammer 7 covers print column 9 for the standard pitch machine. The hammer to print column relationship for the compressed pitch machine at HPC=0 is 1 for 1, 2 for 3, 3 for 5, 4 for 7, 5 for 9, etc.

In a case where the HMR CNTR decodes nine different latches which are used to store matches between the external data and the band, if a match is found and a hammer is over the print column (HPC=SR STEP CNTR), the match is stored in the appropriate decoded latch. Assume also that these matches are stored one scan ahead of the actual firing of the hammers. At the end of each scan, the contents are stored into a second rank of latches which enable the hammer to be fired at the appropriate subscan of the following scan and allows the first rank of latches to store the matches in that scan. Hammers may only be fired during a specific time of a scan (subscan time) if the appropriate register in the second rank is set.

Referring to the standard pitch mode in Table E, it can be seen that hammer 1 may be fired (assuming rank 2 is set) when HPC=0 and subscan=1 or when HPC=3 and subscan=2.

Table F shows the combinations for both standard and compressed pitch with the hammers being subdivided into three hammer groups for the standard pitch machine, Group 1 (HEP 1) comprising hammers 1, 4 and 7, Group 2 (HEP 2) comprising hammers 2, 5 and 8, and Group 3 (HEP 3) comprising hammers 3, 6 and 9. In the compressed pitch machine, HEP 1, HEP 2 and HEP 3 are identical and therefore only one HEP (Hammer Enable Pulse) is required. It should also be noted that for N hammers, 2N print columns are available for compressed pitch and 4/3N print columns for standard pitch.

Figure 4:
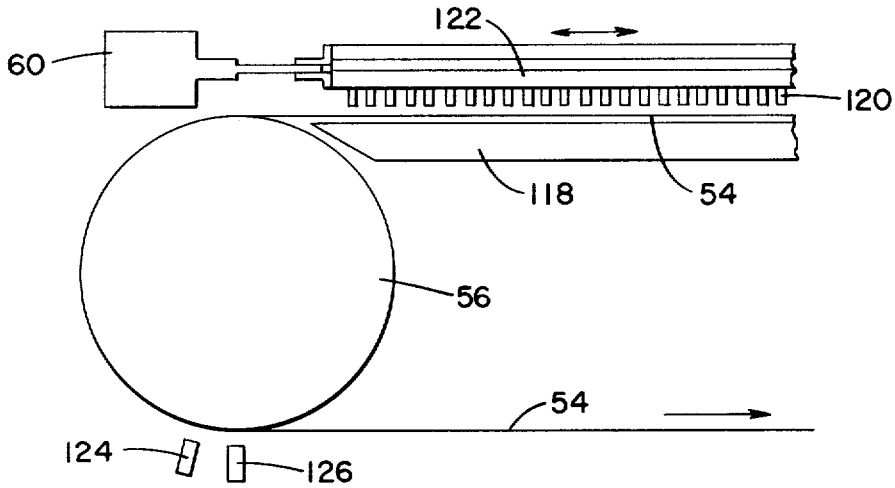
FIG. 4 is a plan view of a portion of the hammer bar assembly relative to the character band.

In FIG. 4 is shown a plan view of a portion of the print band 54 trained around the drive pulley 56 and directed in a path along a platen 118 and past the printing station and positioned to be impacted by the print hammers 120 supported from a hammer bar assembly 122 forward of the hammer bank 18 (FIG. 1), the bar assembly 122 being securely connected to a drive motor in the form of the voice coil 60. The voice coil 60 is controlled by a closed loop servo circuit to actuate the coil for driving or moving the hammer bar assembly 122 in a reciprocating motion horizontally along the platen 118 and the printing station in a time-sharing of the hammers. The character mark transducer 124 and the home mark transducer 126 are shown adjacent the band 54.

Figure 5:
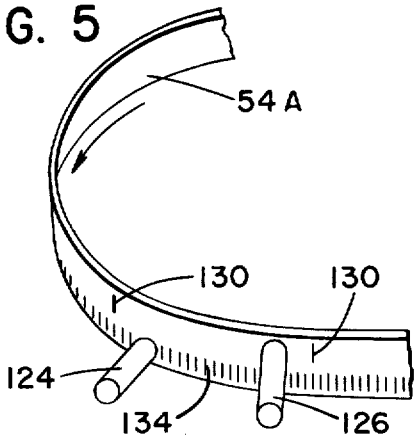
FIG. 5 is a view of a portion of a character band for standard pitch.
Figure 6:
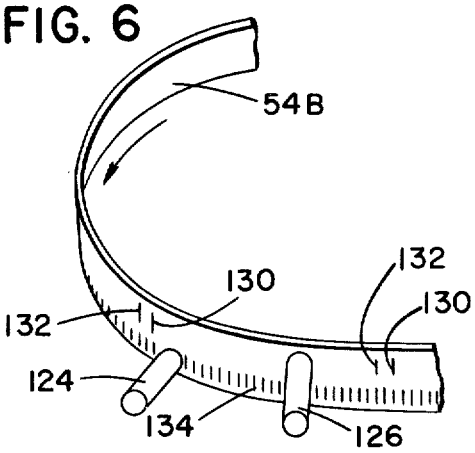
FIG. 6 is a view of a portion of a character band for compressed pitch.

The home pulse indicates to the print band electronic circuitry as to whether the band is a standard or a compressed pitch, the standard pitch band generating one home pulse at the beginning of each font, whereas on the compressed pitch band there are two home pulses generated at the beginning of each font. As seen in the partial showing of the band 54 in FIG. 5, wherein the band is designated as 54A indicating a standard pitch band, such band contains two sets of raised lines or marks with the upper set of marks 130 being the home pulse lines for the character fonts and the lower set of marks 134 being the character pulse lines. Since each band is of identical length and contains 384 characters thereon consisting of one or another of the font sets as mentioned above, such band contains 384 of the marks 134 which are magnetically read by the transducer 124. The upper mark or pulse line 130 is provided for the first character of each font set to identify the number of sets on the particular band and gives the relationship between marks 130 and 134. In the case of standard pitch characters on the band 54A, one of such marks 130 is provided for the first character of each font, whereas in the case of compressed pitch characters, as seen on the band 54B in FIG. 6, two of the marks 130 and 132 are provided for the first and third characters of each font. The printer electronics automatically detects or identifies a standard pitch band 54A or a compressed pitch band 54B whichever is installed on the printer.

Figure 7:
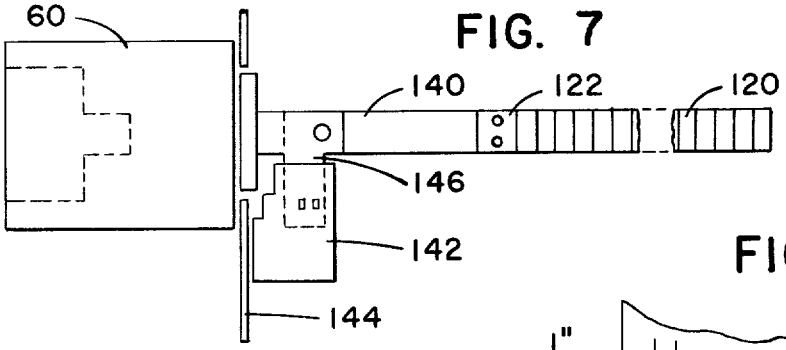
FIG. 7 is a view of the voice coil and associated parts for shifting the hammers.

FIG. 7 shows an elevational view of the voice coil 60 connected by means of a horizontal encoder apparatus 140 to the hammer bar assembly 122 which supports the plurality of hammers 120 adjacent the printing station. The hammers 120 are time-shared and are caused to be moved laterally or back and forth along the printing station by action of the horizontal servo logic and the voice coil 60. A horizontal encode bar reader 142 is secured to a frame member 144 of the printer, the reader 142 having a slot therein for passage of a downwardly extending leg 146 (shown enlarged in FIG. 8) of the encoder element 140. The leg 146 of the encoder element 140 includes a plurality of slots or windows 148 therein, spaced at 1/30 inch, and which are caused to be moved upon movement of the hammer bar assembly 122 by the voice coil 60 past a pair of photo cells 150 and 152 supported in fixed position in the reader 142.

Figure 8:
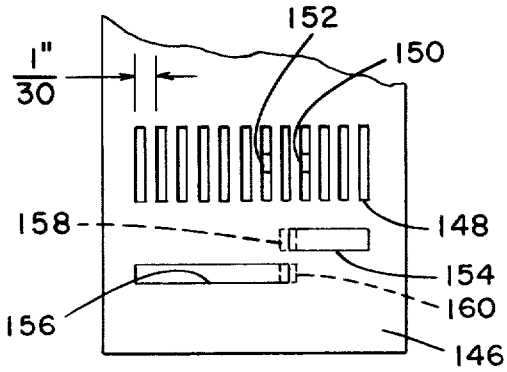
FIG. 8 is an enlarged view of a portion shown in FIG. 7.

As shown in FIG. 8, a pair of horizontally-disposed windows 154 and 156 are positioned below the windows 148 in the leg 146 and a pair of photo cells 158 and 160 are supported to read the home position of the hammer bar assembly 122 or the position of the hammer bar when such bar is in the fully left position, such position causing print hammer No. 1 to be aligned with print column or position No. 1. Since the slots 148 in the code bar 140 are 1/30 inch on centers, the hammers 120 are moved in increments of 1/30 inch by the voice coil 60 as directed from the horizontal servo logic. The voice coil 60 includes a tachometer which feeds back information to the servo logic. It should be noted that by reason of the position of the photo cells 150 and 152, that a sine wave is generated.

Figure 9A:
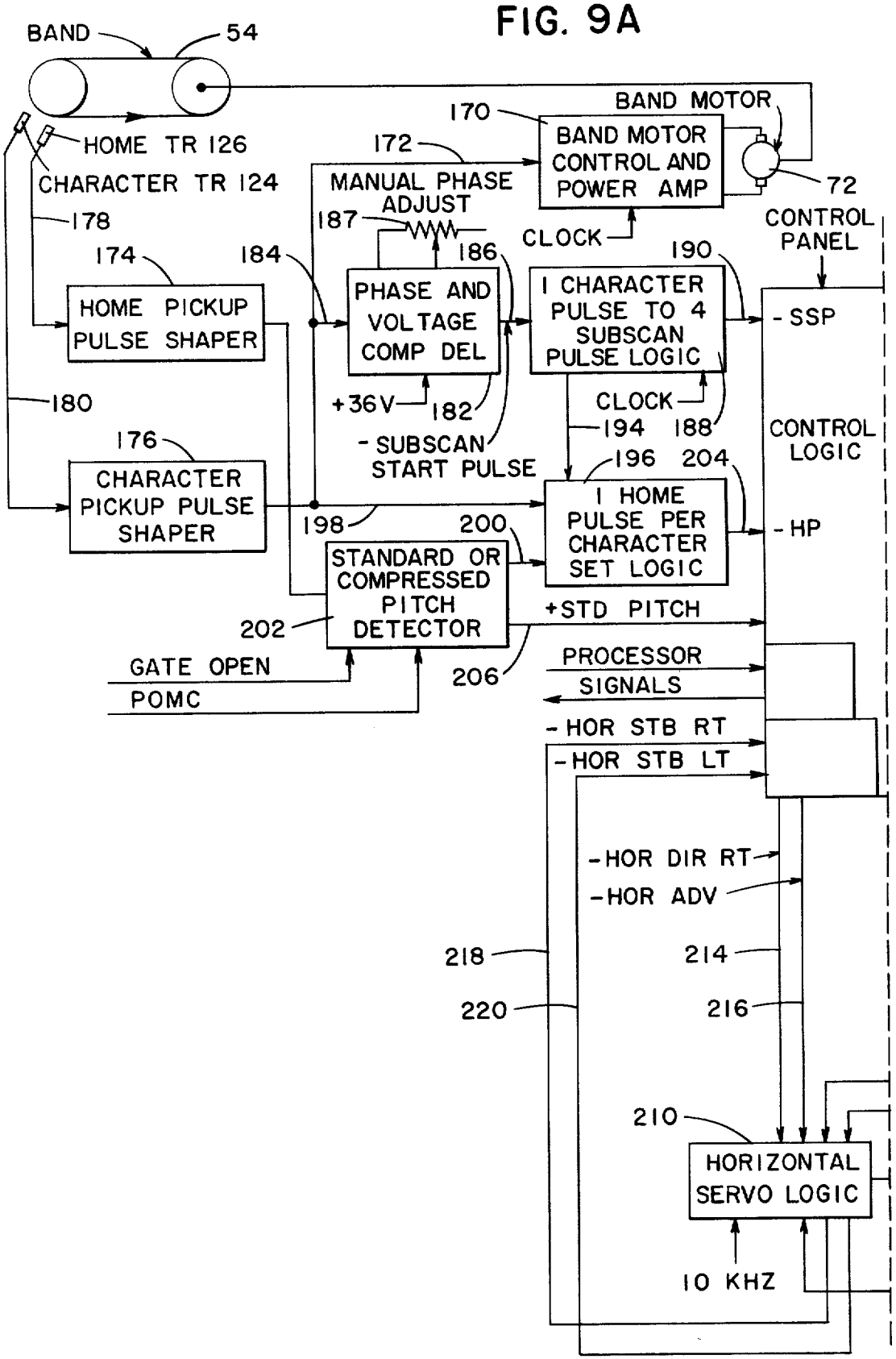
FIGS. 9A and 9B constitute a block diagram of the essential components of the printer system.
Figure 9B:
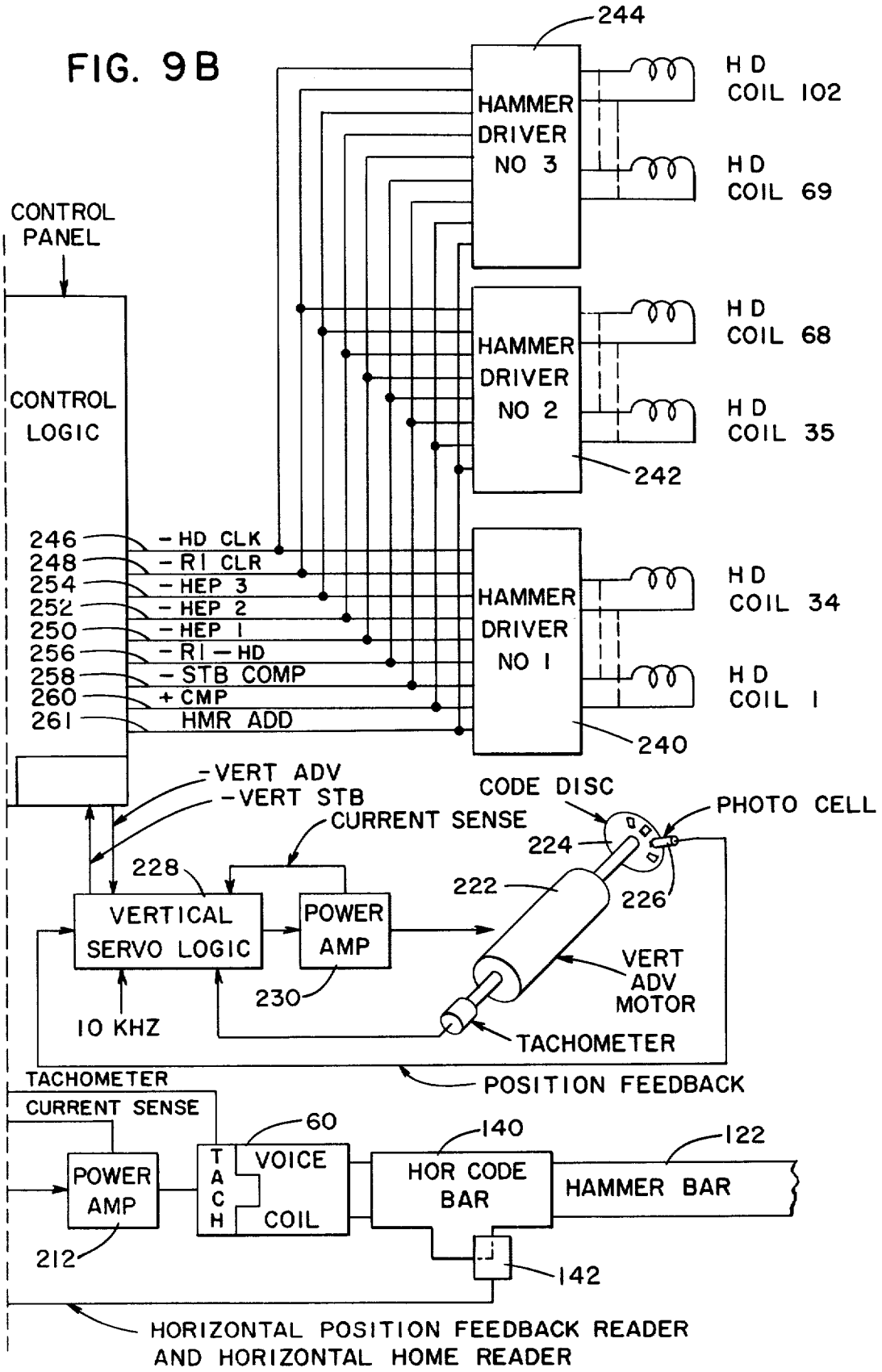

FIGS. 9A and 9B constitute a block diagram of the various elements and components of the dual pitch printing system wherein the band 54 is driven by the band motor 72 under the direction of a band motor control and power amplifier 170 and a line or signal 172 as input to the band motor control and power amplifier along with a clock pulse. Generally, the band 54, whether it is of the standard pitch type or the compressed pitch type, is installed on the machine with the selected font of 48, 64, 96 or 128 characters and the transducers 124 and 126 pick up or sense the characters and the home marks on the band.

A home pickup pulse shaper 174 and a character pickup pulse shaper 176 obtain signals or pulses through leads 178 and 180, respectively, from the home pulse transducer 126 and the character pulse transducer 124 adjacent the band 54 with the character pulses and the home pulses being generated as sine wave shaped signals and digitized by shapers 174 and 176, the purpose of which will be further shown and described. A phase and voltage compensation delay 182 receives a signal 184 from the character pickup pulse shaper 176, such delay logic circuit 182 being utilized to adjust the start of the subscan pulses according to the voltage level of the +36 volt supply by either increasing or decreasing the time delay between the time of sensing the character from the character pulse pickup until a subscan start pulse 186 is generated for the purpose of adjusting the firing time of the hammers. The positioning of the band characters and the hammers 120 are manually adjusted by means of a manual phase adjust device 187. The subscan start pulses 186 are input to a one character pulse to four subscan pulse logic circuit 188, also having a clock input, the logic circuit 188 generating four subscan pulses 190 from each character pulse derived from the character marks on the band 54, the subscan pulses being consistent with the four subscan scheme. One output of the logic circuit 188 is the subscan pulse signal 190 to the control logic and a second output 194 from the logic circuit 188 is sent to a one home pulse per character set logic circuit 196 which has one input 198 from the character pickup pulse shaper 176 and a second input 200 from a standard or compressed pitch detector 202 with the detector 202 having a gate open input signal, a power on master clear input signal and an input from the home pickup pulse shaper 174. The standard or compressed pitch detector 202 senses the presence of either one or two home pickup pulses per character set or font from the home pickup pulse shaper 174 and produces a standard pitch signal which is an active high signal if one pulse per font is detected and is an active low signal if two pulses per font are detected. The one home pulse per character set logic 196 electrically compensates for any misalignment between the character pulse transducer 124 and the home pulse transducer 126. The output of the logic 196 generates one home pulse 204 per character set to the control logic with the home pulse 204 being synchronized to the subscan pulses 190. The output from the detector 202 is sent to the control logic as a standard pitch signal 206 with the second output 200 of the detector 202 being sent to the home pulse character set logic circuit 196.

The time-sharing of the hammers 120 on the printer is accomplished by means of horizontal servo logic circuitry 210 which receives as an input a clock signal and a feedback signal from the horizontal encoder bar 140 secured to the hammer bar assembly 122 which carries the hammers 120 in a horizontal direction as driven by the voice coil 60 connected to a power amplifier 212 with the amplifier receiving its input signal from the horizontal servo logic circuit 210 and having its output signal fed to the voice coil 60. The horizontal code bar reader 142 sends the feedback signal to the horizontal servo logic 210. A tachometer signal and a current sensing signal are fed from the voice coil 60 and the power amplifier to the horizontal servo logic circuit 210. A horizontal directional signal 214 and a horizontal advance signal 216 are input from the control logic to the horizontal servo logic circuit 210 with output signals comprising a horizontal strobe right 218 and a horizontal strobe left 220 being fed into the control logic.

A vertical advance motor 222 has a code disc 224 and a photocell sensing unit 226 connected to feed back a positional signal to a vertical servo logic circuit 228 to provide vertical advancement of the record media after the printing of each line. The vertical advance motor 222 is driven by a power amplifier 230 which has a signal relating to current sensing sent back to the vertical servo logic circuit 228 which sends a vertical strobe signal to the control logic and receives a vertical advance signal from the control logic.

A number of output signals are directed from the control logic to the drivers for the respective hammers 120 to provide proper actuation of the hammers at the precise time that the band characters are presented in front of the several hammers. In the case of the four position standard pitch or the two position compressed pitch machine which has a total of 102 hammers, a hammer driver 240 is responsible for energizing the coils of hammer drivers 1 through 34, a hammer driver 242 is responsible for energizing the coils of hammers 35 through 68 and a hammer driver 244 is responsible for energizing the coils of hammers 69 through 102. The signals which are output from the control logic to the hammer drivers 240, 242, 244 include a hammer driver clock signal 246, a RANK 1 register clear signal 248, a hammer enable pulse (HEP1) signal 250, a hammer enable pulse (HEP2) signal 252, a hammer enable pulse (HEP3) signal 254, a transfer of RANK 1 register contents to hammer driver signal 256, a strobe compare signal 258, a compare signal 260, and hammer address $2^0$–$2^6$ signal 261 all of which are utilized in a manner which will be further described.

As briefly mentioned above, there are four subscans within one scan and a scan is defined as the time period for two successive characters to pass in front of the print column one position. During this time period, there are four distinct times that certain hammer groups can be fired, such times being associated with subscan 1, subscan 2, subscan 3 or subscan 4. Subscans 1, 2, 3 and 4 are used for the standard pitch machine and subscans 1 and 3 are used for the compressed pitch machine. The subscan pulses 190 are shown in FIG. 9A as being sent to the control logic for operation thereby to provide the respective firing pulses (HEP1, HEP2, HEP3) for the various hammer groups as may be implemented according to Table F. The controller then enables the particular circuits to send the respective signals to the appropriate hammer drivers 240, 242, 244 for actuating the coils of the individual hammers 120 to print in either standard or compressed pitch, depending upon the band which is installed on the printer. The control logic for the present invention may be similar to the control logic shown and described in FIGS. 4C, 4D, 4E and 4F of the above-identified application Ser. No. 803,322.

While the control logic for the present invention may have similarities to the prior invention, one main difference is the hammer counter which is complimented in the control logic of this design. The hammer counter follows the PLB/PRT COL counters according to Table E. These addresses are decoded on the hammer driver cards such that individual registers of RANK 1 in the hammer drivers are set or reset at strobe compare time depending upon the state of the compare signal of RANK 1. This procedure is performed since the hammers in the standard pitch machine are not sequentially optioned. For example, the hammers to be fired include hammers 1, 4, 7, etc. when the hammer bank is in position 0 and position 1, HPC=0 and HPC=1, (Table E). In the prior invention, the hammers to be fired were sequential, that is, hammers 1, 2, 3, 4 etc. were sequentially optioned regardless of the type machine or position of the hammer bank.

Figure 10:
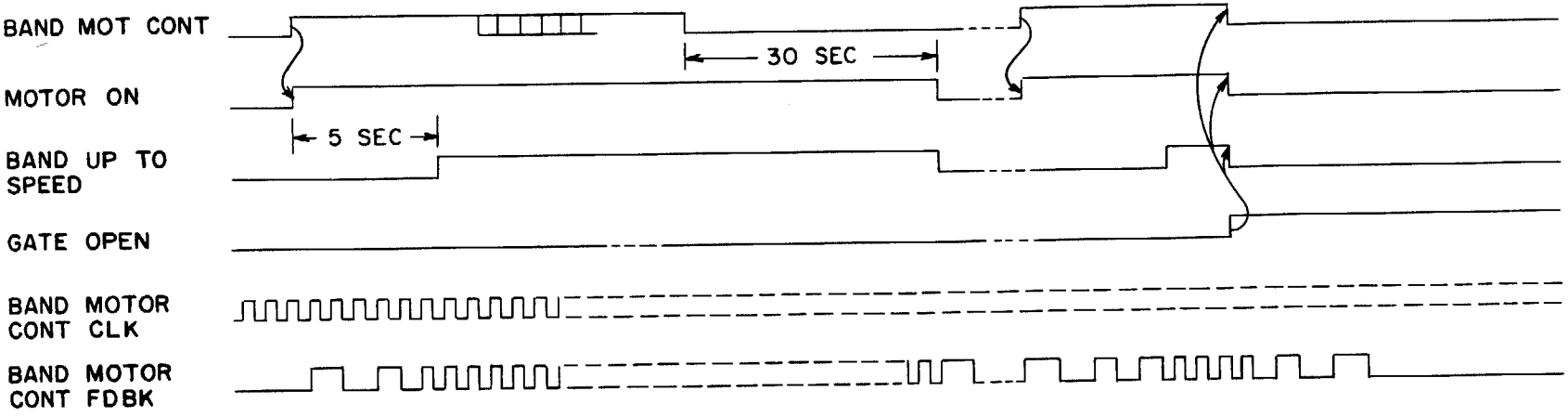
FIG. 10 is a timing diagram of the band motor control.

FIG. 10 shows the timing of the band motor control (BMC) wherein the motor speed reference signals (the character pulses) are compared with the clock pulses. A showing of the band motor control feedback pulses 172, as seen in FIG. 9A, is made to indicate variations therein as compared to the clock pulses. At a given time after the band motor is turned on, for example, five seconds, the band is up to full speed and if no printing operation is performed for thirty seconds, the band motor turns off. The signal line 172 is the feedback from the character pulse on the band and the character pulses are at a prescribed distance apart so that the time duration between pulses can be monitored and the band motor control can adjust the voltage to maintain the band at a constant speed. The clock signal shown in FIG. 10 is compared to the signal line 172 to adjust the motor speed and when the band motor is turned on, the hammers 120 are set in the home position.

Figure 11:
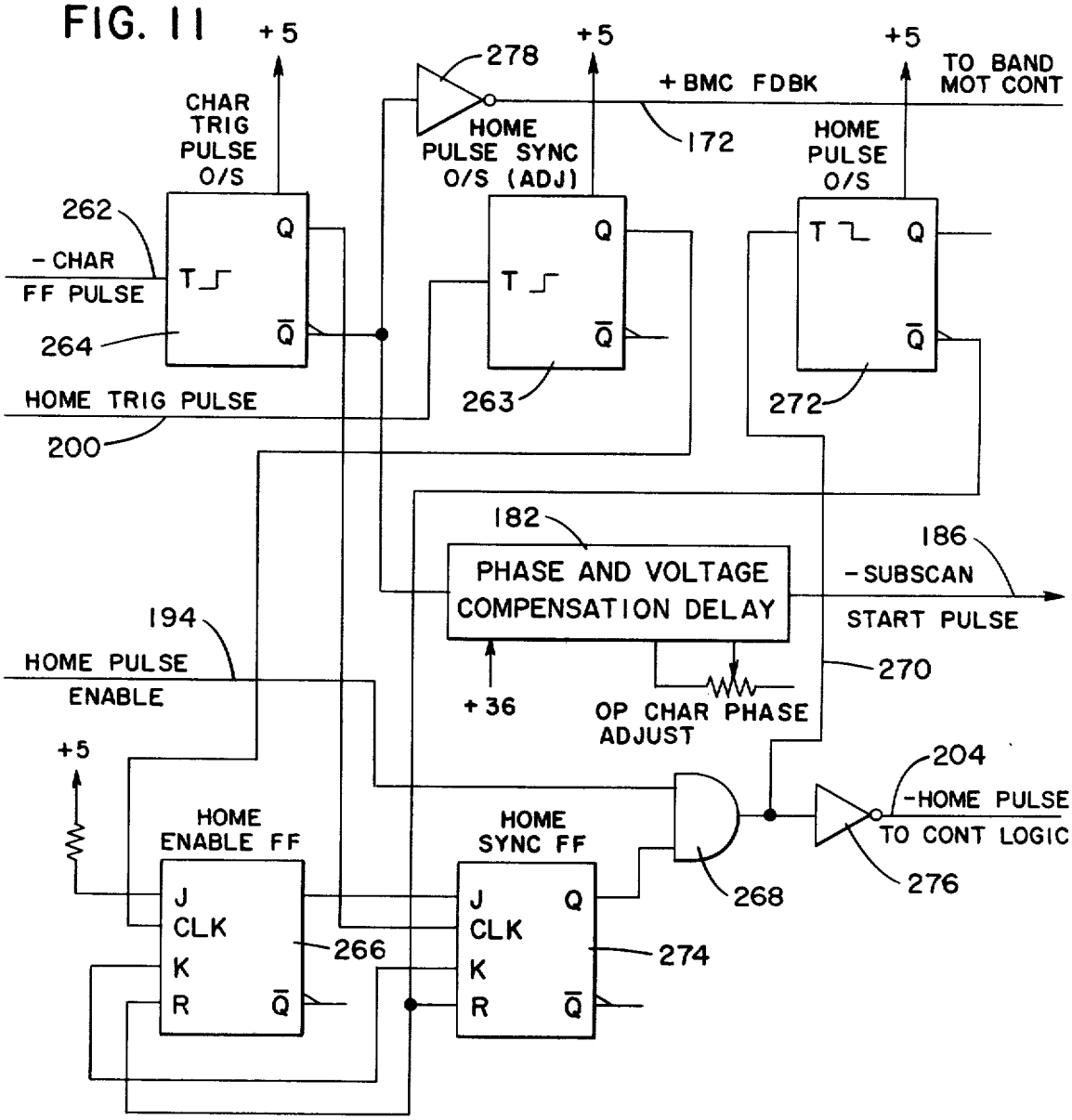
FIG. 11 is a logic diagram for a portion of the character pickup pulse generator, the one home pulse per character set logic; and the phase and voltage compensation delay.

FIG. 11 shows the home pulse enable signal 194 which is generated once per character mark from the logic 188 and is used as an input to a home-to-character pulse circuit which electrically compensates for any misalignment between the character pulse transducer 124 and the home pulse transducer 126. The adjustment of a home pulse one-shot device 263 allows the home pulse 204 to be positioned relative to any one of five character pulses. A character pulse 262 triggers a character pulse one-shot device 264 and the home trigger pulse 200 triggers the home pulse one-shot device 263 whereupon a home enable flip flop 266 is set on the trailing edge of the one-shot 263. When a home pulse enable signal 194 is generated during the fourth subscan for the character pulse, AND gate 268 is enabled and a home pulse 270 is generated. When the home pulse enable signal drops, the reset of a home pulse one-shot device 272 is triggered and the pulse resets the home enable flip flop 26 and a home sync flip flop 274 to complete the synchronizing operation. The output of AND gate 268 is sent through an inverter 276 as a home pulse signal 204 to the controller and the output of the character trigger pulse one-shot device 264 is sent through an inverter 278 as the band motor control feedback signal 172 to the band motor control. The output of the character trigger pulse one-shot device 264 is sent to the phase and voltage compensation delay 182 with the output being a subscan start pulse 186 to the one character pulse to four subscan pulse logic 188 and then to the control logic.

Figure 12B:
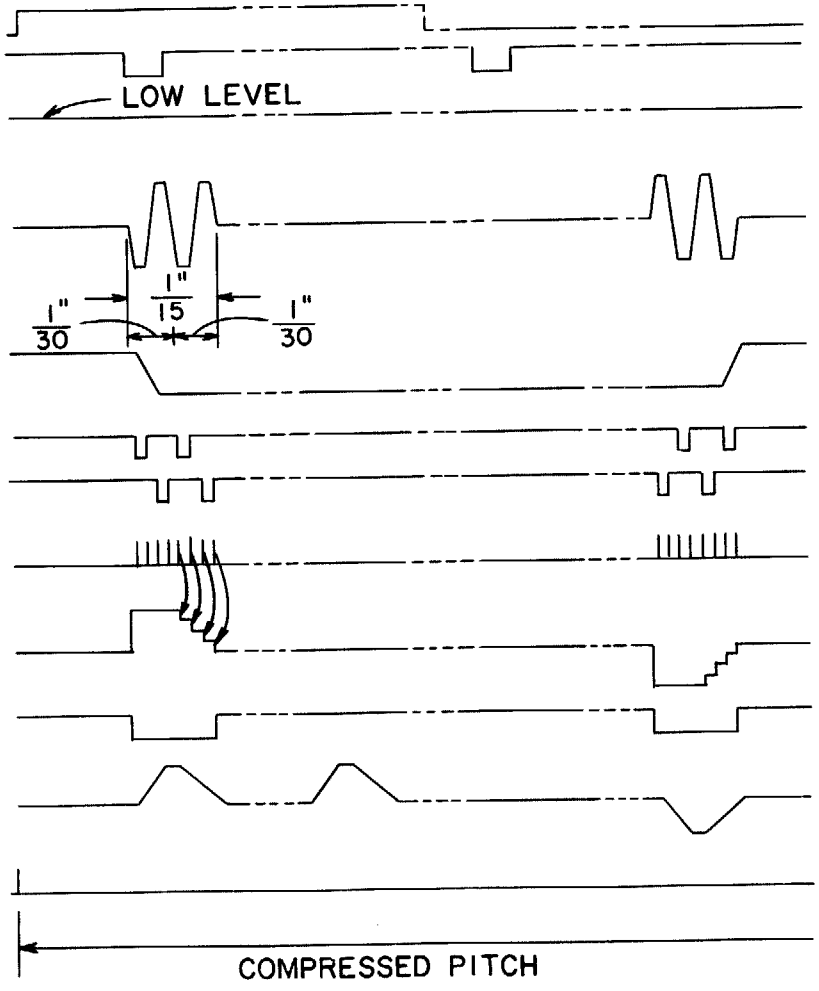
FIGS. 12A and 12B constitute timing diagrams of the horizontal shifting of the hammers for standard pitch and compressed pitch, respectively.
Figure 12A:
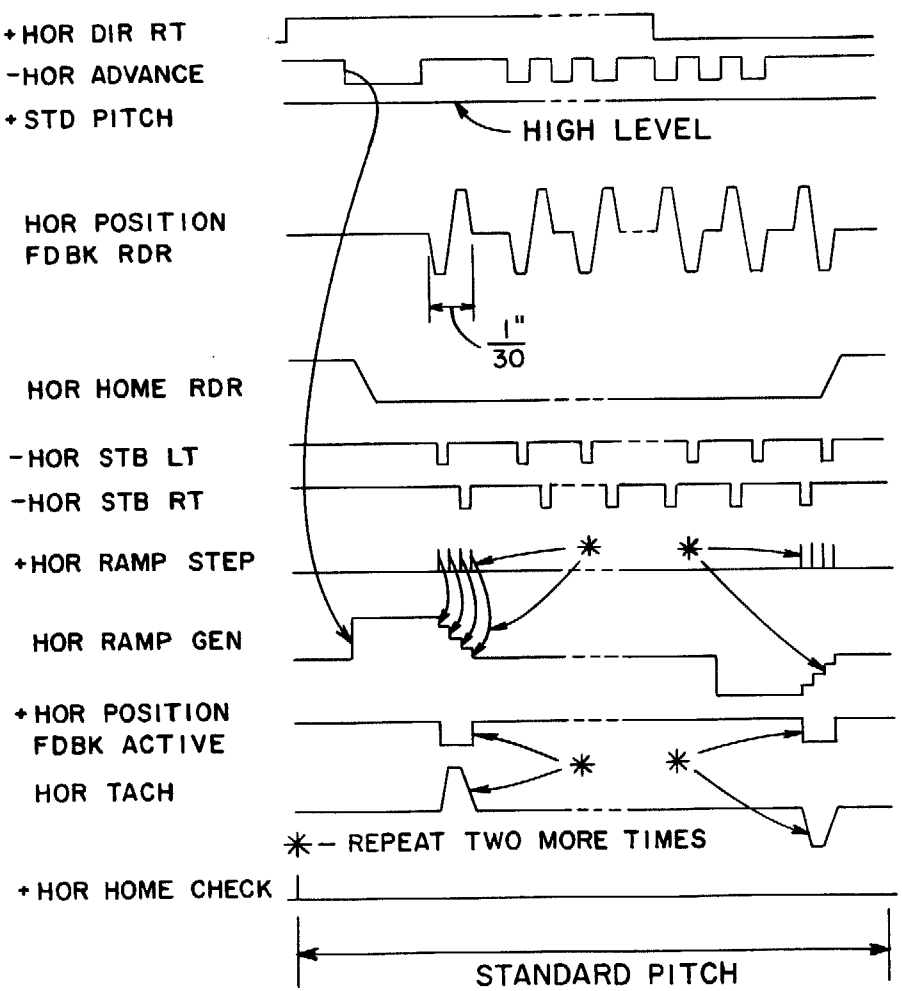

FIG. 12A shows a timing diagram of the shifting of the hammers 120 for standard pitch and FIG. 12B shows a similar diagram for compressed pitch. In the case when a standard pitch band is on the printer, the horizontal motion operation is initiated when the horizontal advance signal goes low and the action clears a ramp step shift register wherein the most significant byte of the shift register goes low causing the horizontal ramp generator to become active, a bilateral switch is closed and the reference voltage from a resistor network is fed to one of the inputs of a horizontal ramp generator, the selected input being dependent upon the horizontal direction right signal. If the signal is high, a shift to the right is required, the switch is closed and the reference signal is fed to the lower input of the ramp generator to produce a positive going ramp on the output thereof. If the horizontal direction right signal is low, a shift to the left is required, a switch is closed and the reference signal is fed to the upper input of the ramp generator to produce a negative going ramp at the output thereof.

As further seen in FIGS. 12A and 12B, the distance of motion of the hammer bar assembly 122 is controlled by the horizontal position feedback reader 142 which generates a sine wave signal for every increment of motion of 1/30 inch. When the voice coil 60 is caused to be moved to the right, the sine wave goes negative first and then positive, and when the voice coil is caused to be moved to the left, the sine wave goes positive first and then negative. During a negative swing of the signal, the horizontal strobe left pulse 220 is generated and during the positive swing of the signal, the horizontal strobe right pulse 218 is generated with a strobe left and a strobe right for each horizontal position signal. The number of horizontal position pulses necessary to terminate the horizontal motion is determined by the selection of either standard or compressed pitch, with the standard pitch mode requiring one horizontal position pulse and covering the distance of 1/30 inch and the compressed pitch requiring two horizontal position pulses covering the distance of 1/15 inch. When moving to the right on the trailing edges of the first pulse of the compressed pitch or the initial pulse of the standard pitch the horizontal strobe right pulse, the horizontal advance signal is terminated, and when moving to the left on the trailing edge of the first pulse of the compressed pitch or the initial pulse of the standard pitch horizontal strobe left pulse, the horizontal advance signal is terminated. This is shown to be the point after initiation of each pulse or no or zero advance for the standard pitch and the point after one pulse or 1/30 inch advance for the compressed pitch. When the printer is set for standard pitch, the standard pitch signal is high, and when in compressed pitch, the standard pitch signal is low, as shown by the high and low levels for the standard pitch. During the horizontal advance time, a horizontal ramp step signal is produced for each horizontal strobe left pulse 220 and for each horizontal strobe right pulse 218. Upon termination of the horizontal advance signal, the reset is removed from the ramp step shift register and the output of the ramp generator is reduced in four steps by the horizontal ramp step signal to provide a controlled rate of deceleration, it being seen that after the initial strobe right pulse or zero advance for the standard pitch and after the first strobe right pulse or 1/30 inch advance for the compressed pitch, the voice coil 60 and the hammer bar assembly are then allowed to decelerate at a controlled rate for the remaining 1/30 inch or the distance equivalent to the four steps down of the ramp generator.

Figure 13:
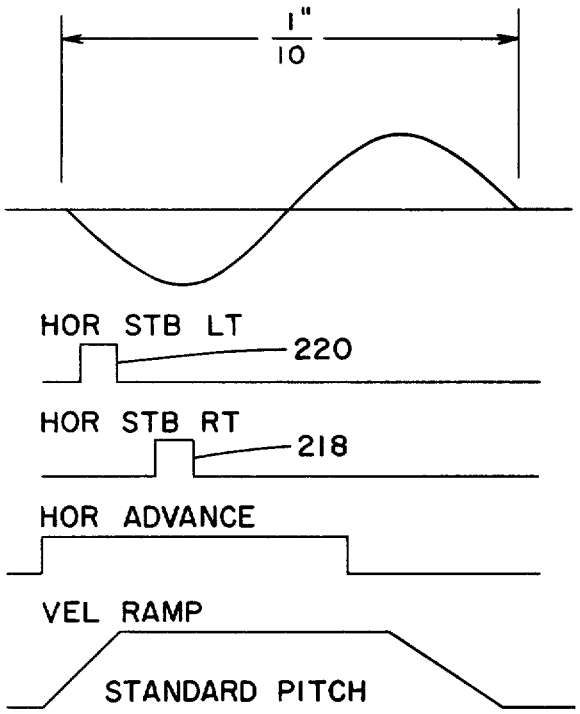
FIG. 13 is a showing of the wave shape and timing diagram of controls for hammer displacement in standard pitch.

FIG. 13 shows the timing pattern relative to horizontal shifting of the hammers 120 for the standard pitch machine wherein the hammer bar assembly 122 is moved in three equal increments of 1/30 inch for the 1/10 inch spacing of the characters at which time a portion of the hammers are in a position such that they can be optioned to print if selected to do so.

Figure 14:
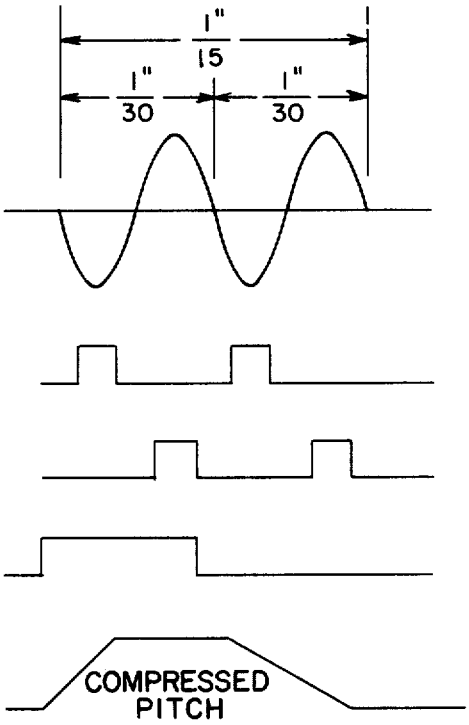
FIG. 14 is a showing of the wave shape and timing diagram of controls for hammer displacement in compressed pitch.

FIG. 14 shows the timing pattern relative to horizontal shifting of the hammers for the compressed pitch machine wherein the hammer bar assembly 122 is moved in two increments of 1/30 inch for the 1/15 inch spacing of the characters. When the hammer bar 122 is caused to be moved 1/30 inch, one sine wave is generated as a function of the displacement. The horizontal strobe left pulse 220 and horizontal strobe right pulse 218 are shown in relation to the position of the corresponding wave shape wherein it is seen that for standard pitch and going in a right direction the horizontal advance is dropped after the initial horizontal strobe right pulse is received from the code bar assembly 140. In standard pitch the velocity ramp shows driving of the bar for less than 1/30 inch and then decelerates at a controlled rate for the remaining 1/30 inch, whereas in compressed pitch, the hammer bar 122 is driven for 1/30 inch and then decelerates at a controlled rate for the second 1/30 inch for a complete shift of the hammers 120. It should also be noted that in compressed pitch that the horizontal advance is dropped after one horizontal strobe right pulse 218 is seen by the control logic.

Figure 15:
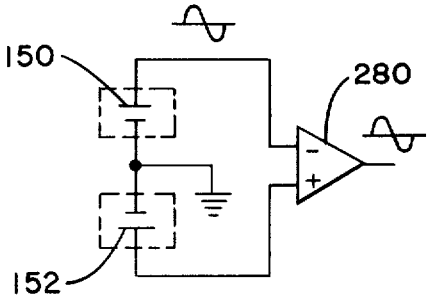
FIG. 15 is a circuit diagram of the sensing means for horizontal displacement of the hammers.

FIG. 15 is a circuit diagram of the sensing means or the horizontal displacement transducer 150 and 152 connected to the inputs of an operational amplifier 280 in the manner for generating a sine wave of the displacement of the slots 148 past the photocells 150 and 152.

Figure 16:
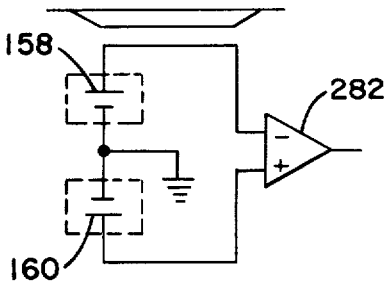
FIG. 16 is a circuit diagram of the sensing means for home position of the hammers.

FIG. 16 is a circuit diagram of the sensing means or the horizontal home transducers 158 and 160 connected to the inputs of an operational amplifier 282 in the manner for generating a wave shape for the home position of the hammers 120. The wave shapes are shown above the diagrams in relationship as to the functions of the various elements in the positioning of the hammer bar assembly 122.

Figure 17:
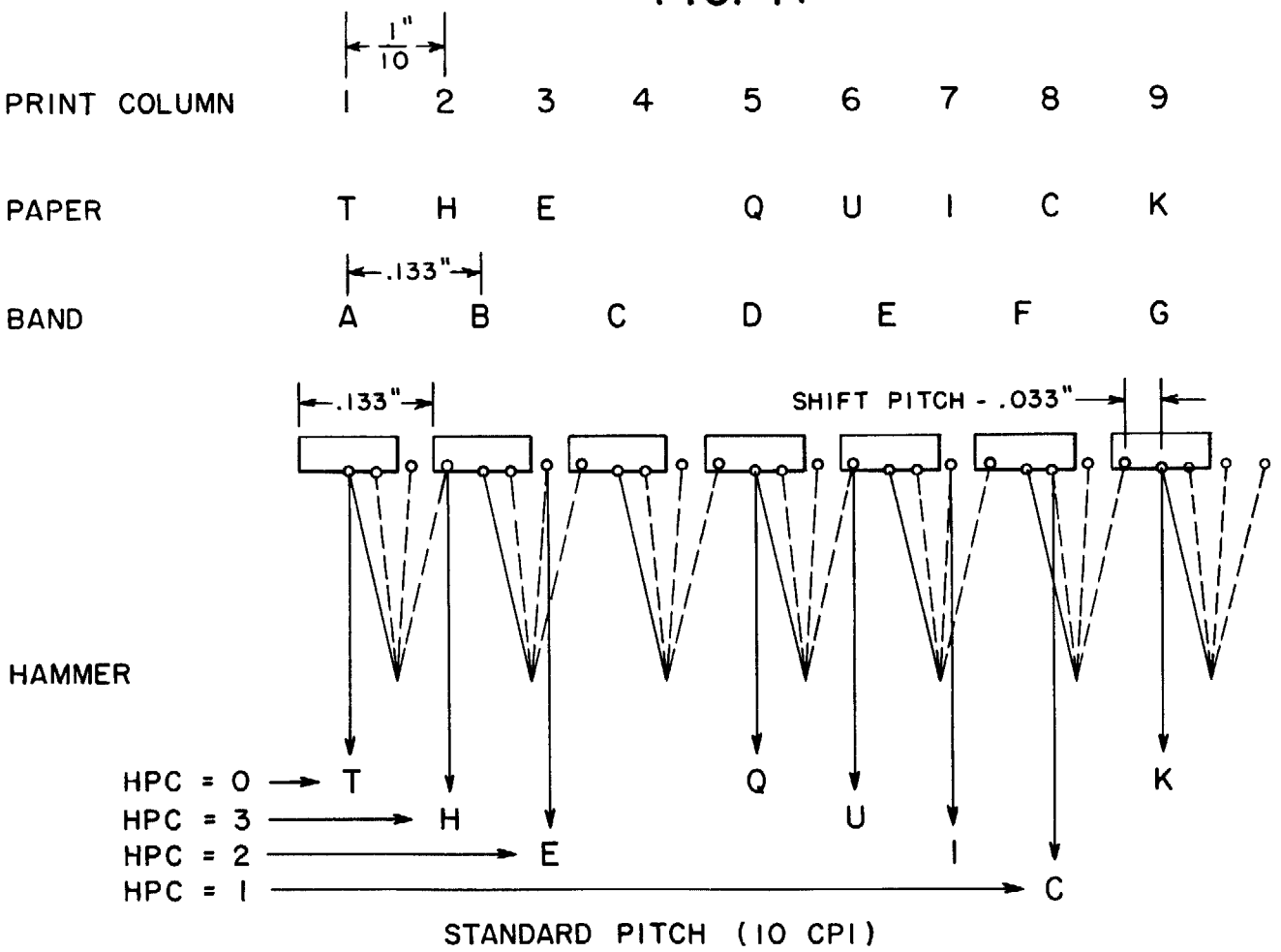
FIG. 17 is a diagram showing the relationship of several hammers with print column positions and characters on the band in a four position standard pitch mode.

FIG. 17 shows a diagram of the relationship of several of the print hammers 120 with the print column positions and the character positions of the band 54 for a four position standard pitch mode. In this relationship, the print columns are spaced at 1/10 inch with printing on the paper being at the same spacing. The characters on the band are spaced at 4/30 (0.133) inch and the hammers are like spaced at 0.133 inch centerlines. Each of the hammers is horizontally movable 1/30 (0.033) inch as shown by the solid and dotted lines and is designated as position 0, 1, 2 or 3 in the standard pitch printing mode. The print scan arrangement is shown for printing the respective characters in the four positions of the print hammers.

Figure 18:
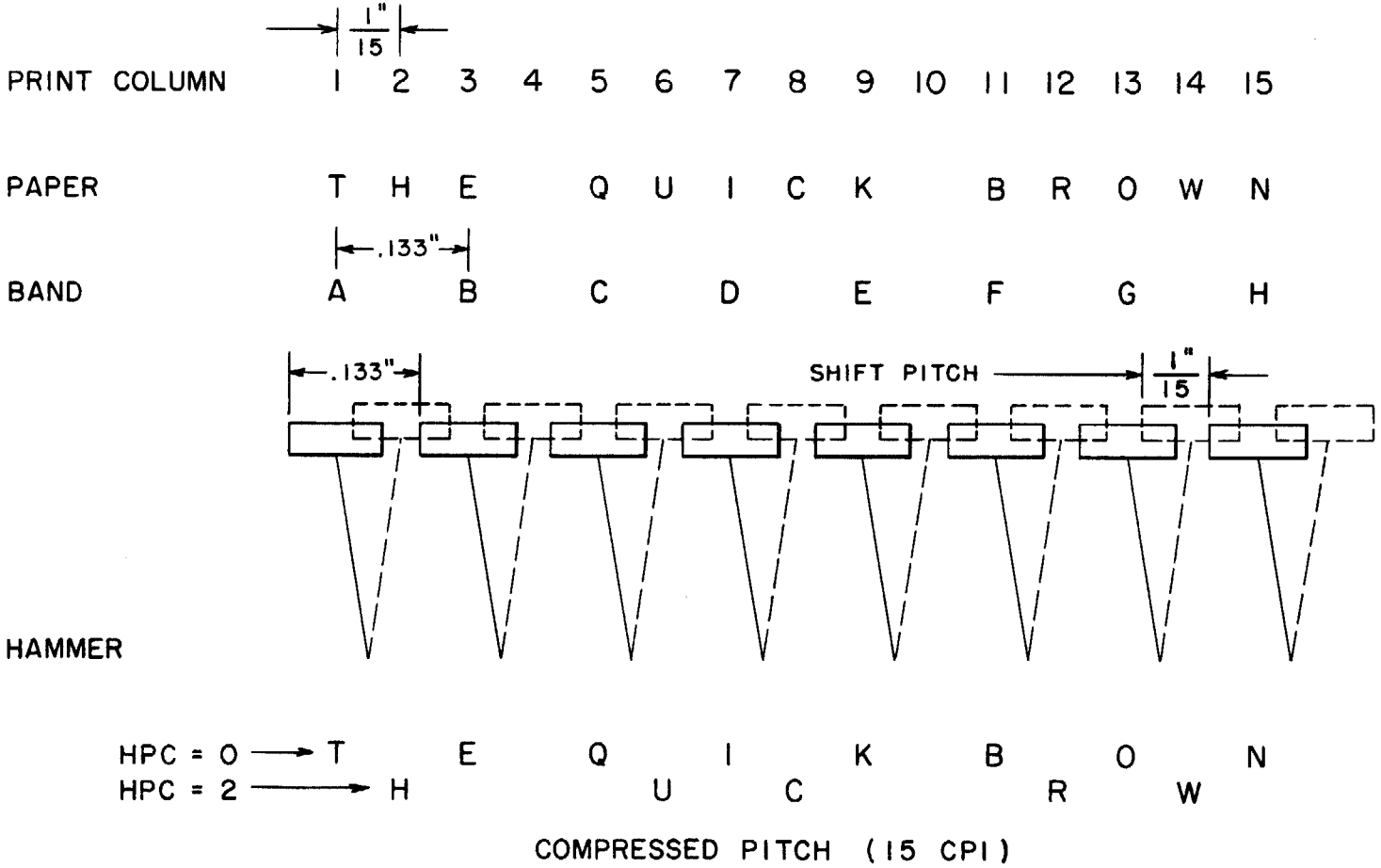
FIG. 18 is a diagram similar to the diagram shown in FIG. 17 except for a two position compressed pitch mode.

FIG. 18 shows a similar view as FIG. 17 of the relationship of several print hammers 120 with the print column positions and the character positions on the band for a two position compressed pitch mode. In this relationship, the print columns are spaced at 1/15 inch with printing on the paper being at the same spacing. As in the standard pitch mode, the characters on the band are spaced at 4/30 (0.133) inch and the hammers are positioned so that every other hammer is in a print column position to cover the spacing for the compressed pitch. Each of the hammers is horizontally movable 1/15 (0.067) inch to either one of the two positions and is designated as position 0 or position 2 in the compressed pitch printing mode. The hammers are spaced across every other print column position which are on 1/15 inch centerlines. The print scan arrangement is shown for printing the respective characters in the two positions of the print hammers.

In the operation of the dual pitch printer wherein it is highly desireable to print at a higher speed when printing in the compressed pitch mode (15 characters per inch) rather than the standard pitch mode (10 characters per inch), the individual hammers 120 are enabled or caused to operate in two different positions (one shifting motion) to print an entire line of 204 print columns. The two different print positions are spaced horizontally by a distance of 1/15 inch and the hammers are shifted or moved by the voice coil 60 along such distance.

When printing in the compressed pitch mode, each individual hammer 120 is "optioned" to print by using the one subscan scheme since all the optioned hammers are directly aligned with their respective type characters on the print band 54B simultaneously, such spacing of the hammers and of the type characters being on 0.133 inch centers. The resulting print speed using predetermined cycle times and print band velocity as a given set of parameters will be 720 lines per minute with a 48 character set print band in the compressed pitch mode.

When printing in the standard pitch mode, every third print hammer is "optioned" to print and the other hammers are inactive or not enabled to print. Hammers 1, 4, 7, etc. are optioned to print on 0.4 inch centers while hammers 2, 3, 5, 6, 8, 9, etc. remain inactive, and then the hammers 1, 4, 7, etc. will be enabled to print on such centers at 10 characters per inch along the print line.

When the 1, 4, 7, etc. columns have been optioned to print, the horizontal shift mechanism moves the hammer bar assembly with the hammers to an adjacent horizontal position 1/30 inch to the left. Print column positions (hammers) 2, 5, 8, etc. are then optioned to print in print positions 1/10 inch to the right of the previously printed columns.

The third portion of the print cycle (following the second 1/30 inch horizontal shift to the left) causes print positions (hammers) 3, 6, 9, etc. to be optioned to print in positions 1/10 inch to the right of the previously printed columns.

The fourth portion of the print cycle (following the third 1/30 inch horizontal shift to the left) causes print positions (hammers) 1, 4, 7, etc. to be optioned to print and thereby complete the entire line of 136 print columns and the printing sequence for that print line. The resulting print speed using the same predetermined cycle times and print band velocity as the given set of parameters will be 360 lines per minute with a 48 character set print band in the standard pitch mode.

It is thus seen that herein shown and described is a dual pitch impact printing mechanism for printing at one pitch or at another pitch dependent upon the type character band installed on the printer. The control mechanism provides for printing at the compressed pitch in a faster operation or at a higher printing speed when printing at fifteen characters per inch as compared with the standard pitch mode of operation and printing at a lower printing speed in the standard pitch mode of ten characters per inch. Although one basic embodiment has been disclosed herein, variations thereof may occur to those skilled in the art. It is contemplated that all such variations not departing from the spirit and scope of the invention hereof are to be construed in accordance with the following claims.

What is claimed is:

1. An impact printer capable of printing at one or another character pitch, a plurality of removable type character carrying members, one member having characters defining standard pitch and another member having characters defining compressed pitch, each of said characters being spaced at a predetermined distance thereon, a plurality of impact members adjacent a selected one of said type character carrying members and spaced at a like predetermined distance as said characters, means for conditioning said impact members in accordance with the pitch of said characters on the selected one of said type character carrying members, and, means for plural print column shifting of said impact members for printing at one rate in standard pitch mode and for singular print column shifting of said impact members for printing at a higher rate in compressed pitch mode.

2. The printer of claim 1 wherein each of said type character carrying members includes pitch defining indicia thereon.

3. The printer of claim 2 wherein said printer includes means sensing the pitch defining indicia.

4. The printer of claim 2 wherein said printer includes means responsive to said pitch defining indicia for conditioning said impact members.

5. The printer of claim 1 wherein said moving means includes means for tracking said impact members in relation to print column positions for moving said impact members one print column position for printing in said compressed pitch mode and for moving said impact members more than one print column position for printing in said standard pitch mode.

6. The printer of claim 5 wherein said tracking means includes impact member address means for enabling said impact members after moving thereof.

7. The printer of claim 1 wherein said moving means comprises electromagnetic means connected with said impact members.

8. In a printer, means for printing characters at one rate in a standard character pitch mode and for printing characters at a higher rate in a compressed character pitch mode, a plurality of removable type character carrying members, one member having standard pitch characters and another member having compressed pitch characters thereon, said type characters being spaced at a predetermined distance, a plurality of impact members adjacent said type characters and spaced at a like distance, means for sensing said one or another character pitch for printing in either standard or compressed pitch mode dependent upon the type character carrying member on the printer, and means for plural column shifting of said impact members for printing at one rate in standard pitch mode and for singular column shifting of said impact members for printing at a higher rate in compressed pitch mode.

9. In the printer of claim 8 including means for counting the position of said impact members in relation to the print column positions; said shifting means shifting said impact members one print column position for printing in compressed pitch mode and shifting said impact members more than one print column position for printing in standard pitch mode.

10. In the printer of claim 9 wherein said counting means includes impact member address means for enabling said impact members after shifting thereof.

11. In the printer of claim 8 wherein said impact members comprise a plurality of hammers displaceable from one to another print column position.

12. In the printer of claim 8 wherein said shifting means includes electromagnetic means connected with said impact members and operated an amount in each cycle of operation as defined by the sensed character pitch.

13. In the printer of claim 12 wherein said electromagnetic means comprises a voice coil.

14. In the printer of claim 8 wherein each said type character carrying member is a removable band.

15. In the printer of claim 8 wherein said sensing means comprise transducers for detecting standard and compressed pitch characters.

16. For printing characters in a select one of two pitch modes, an impact printer including:

a type character carrying member having characters thereon spaced a first predetermined distance from each other; a plurality of impact members adjacent said type character carrying member and spaced a second predetermined distance from each other;

means for shifting said impact members over a first set of printing positions for printing each line of characters in a standard pitch mode, and for shifting said impact members over a second set of printing positions for printing each line in a compressed pitch mode, said first set including a greater number of printing positions than said second set; and means for selecting one of said character pitch modes and means for conditioning said impact members in accordance with the selected mode.

17. The impact printer of claim 16 wherein:
said second predetermined distance is equal to said first predetermined distance.

18. The impact printer of claim 16 wherein:
said first set consists of four printing positions and said second set consists of two printing positions.

19. The impact printer of claim 16 including:
means for indicating one of said character pitch modes, said selecting means including means for sensing the presence of said indicating means.

20. The impact printer of claim 19 wherein:
said indicating means is carried by said type character carrying member.

* * * * *